US009909760B2

(12) United States Patent
Chen et al.

(10) Patent No.: US 9,909,760 B2
(45) Date of Patent: Mar. 6, 2018

(54) PUSH-BUTTON TYPE FLINT IGNITION MECHANISM CAPABLE OF AUTOMATIC RESETTING

(71) Applicant: Long Chen, Guangdong (CN)

(72) Inventors: Long Chen, Foshan (CN); Li Wu, Foshan (CN)

( * ) Notice: Subject to any disclaimer, the term of this patent is extended or adjusted under 35 U.S.C. 154(b) by 52 days.

(21) Appl. No.: 14/912,135

(22) PCT Filed: Dec. 23, 2013

(86) PCT No.: PCT/CN2013/090241
§ 371 (c)(1),
(2) Date: Feb. 15, 2016

(87) PCT Pub. No.: WO2015/089854
PCT Pub. Date: Jun. 25, 2015

(65) Prior Publication Data

US 2016/0201906 A1 Jul. 14, 2016

(30) Foreign Application Priority Data

Dec. 17, 2013 (CN) ..... 2013 1 0695117

(51) Int. Cl.
*F23Q 2/46* (2006.01)
*F23Q 1/06* (2006.01)
(Continued)

(52) U.S. Cl.
CPC ..... *F23Q 1/06* (2013.01); *F23Q 1/02* (2013.01); *F23Q 2/161* (2013.01); *F23Q 2/46* (2013.01); *F23Q 2/48* (2013.01); *F23Q 2/34* (2013.01)

(58) Field of Classification Search
CPC ..... F23Q 1/02; F23Q 1/06; F23Q 2/46
(Continued)

(56) References Cited

U.S. PATENT DOCUMENTS 2,583,691 A * 1/1952 Florman ..... F23Q 2/08 220/502
2,845,784 A * 8/1958 Hinn ..... F23Q 2/162 431/131

(Continued)

OTHER PUBLICATIONS

International Search Report for PCT/CN2013/090241, dated Jul. 23, 2014.

*Primary Examiner* — Avinash Savani
*Assistant Examiner* — Deepak Deean
(74) *Attorney, Agent, or Firm* — Milstein, Zhang & Wu LLC; Duan Wu, Esq.

(57) ABSTRACT

A push-button type flint ignition mechanism that is capable of automatic reset, including: a built-in flint, a grinding wheel abutting the flint, an energy storage member that stores energy through deformation, a driving wheel rotating in the same direction as the grinding wheel when the energy storage member releases energy, a wheel axle about which the driving wheel rotates, a driving body pushed by the energy storage member when the energy storage member releases energy, a plucking portion located on the driving body and capable of plucking the driving wheel to make the driving wheel rotate, a blocking member capable of blocking the movement of the driving body, a moving member capable of making linear movements back and forth inside the mechanism and capable of squeezing the energy storage member to cause elastic deformation in the latter, and a reset member capable of pushing the moving member to reset; wherein, when no external force is exerted on the mechanism, the projections of the plucking portion and the driving wheel, respectively onto the plane perpendicular to the direction of movement by the moving member, do not overlap. Moreover, and optionally, when the energy storage member finishes releasing energy, the projections of the plucking portion and the driving wheel, respectively onto (Continued)

the plane perpendicular to the direction of movement by the moving member, do not overlap.

25 Claims, 12 Drawing Sheets

(51) Int. Cl.
*F23Q 1/02* (2006.01)
*F23Q 2/16* (2006.01)
*F23Q 2/48* (2006.01)
*F23Q 2/34* (2006.01)

(58) Field of Classification Search
USPC ..... 431/274
See application file for complete search history.

(56) References Cited

U.S. PATENT DOCUMENTS 3,263,455 A * 8/1966 Smith ..... F23Q 2/46 205/169
3,617,160 A * 11/1971 Racek ..... F23Q 2/46 431/125
3,748,086 A * 7/1973 Retzler ..... F23Q 2/167 431/131
3,752,637 A * 8/1973 Norman ..... F23Q 2/08 431/274
3,819,320 A * 6/1974 Chevallier ..... F23Q 2/161 431/254
3,825,401 A * 7/1974 Chevallier ..... F23Q 2/161 431/274
3,827,852 A * 8/1974 Chevallier ..... F23Q 2/161 431/254
3,910,751 A * 10/1975 Chernock ..... B21H 7/14 431/273
3,925,004 A * 12/1975 Lauri ..... F23Q 2/46 431/131
3,938,942 A * 2/1976 Torassa ..... F23Q 2/167 431/142
3,953,996 A * 5/1976 Chernock ..... B21H 7/14 72/102
3,963,412 A * 6/1976 Chernock ..... F23Q 2/46 431/273
4,099,907 A * 7/1978 Fuller ..... F23Q 2/161 431/254
4,146,358 A * 3/1979 Dixon ..... F23Q 2/161 431/254
4,596,525 A * 6/1986 Hsu ..... F23Q 2/18 431/124
5,020,990 A * 6/1991 Chen ..... F23Q 2/46 431/274
5,120,216 A * 6/1992 Iwahori ..... F23Q 2/46 431/130
5,358,401 A * 10/1994 Iwahori ..... F23Q 2/46 431/153
5,468,144 A * 11/1995 Iwahori ..... F23Q 2/46 431/254
6,537,062 B1 3/2003 Wang
6,565,353 B2 * 5/2003 Yang ..... F23Q 2/161 431/153
7,273,026 B2 * 9/2007 Mandal ..... F01L 1/146 123/198 F
2003/0003412 A1 1/2003 Yang

* cited by examiner

PUSH-BUTTON TYPE FLINT IGNITION MECHANISM CAPABLE OF AUTOMATIC RESETTING

FIELD OF THE INVENTION

The present invention relates to ignition mechanism and apparatuses comprising such a mechanism, such as lighters (or igniters), which include pocket lighters and utility lighters, as well as disposable lighters and refillable lighters.

BACKGROUND OF THE INVENTION

At the present, there are mainly two kinds of ignition mechanisms for lighters: piezoelectric ignition mechanism and flint ignition mechanism. Electronic lighters that utilize a piezoelectric ignition mechanism have the advantage that its usage does not get one's hands smeared, and that the operation is simple. Therefore, although electronic lighters are relatively more expensive, many consumers are still more willing to purchase them. However, lighters that utilize a flint ignition mechanism still occupy a significant portion of both the international and domestic markets due to their high reliability, high rate of ignition, not being affected by the surrounding weather conditions, and so on. A remaining problem for lighter manufacturers all over the world is how to realize the advantages of flint ignition mechanisms through modification of conventional ways of flint ignition to make it simpler and more sanitary with only minimal increase in production costs—especially challenging is how to standardize parts for a flint ignition mechanism in a fashion that is similar to what has been achieved with regard to the piezoelectric ignition mechanism.

Chinese Patent No. 200910226804.2 discloses a lighter that includes a housing, a frame, a wind shield, an outlet needle, a lever, an ignition wheel assembly, a flint, a button, a gear block, and a reset spring, where the ignition wheel assembly comprises a rotating axle, an ignition wheel, a drive tab and a side wheel, and the ignition wheel, the drive tab and the side wheel are all threaded over the rotating axle. The drive tab is provided in between the ignition wheel and the side wheel; the drive tab, the ignition wheel and the rotating axle cooperate to relay the motion; the side wheel and the rotating axle cooperate to relay the motion. The side of the side wheel that faces the drive tab is equipped with a plurality of coupling teeth about its axial aperture; these plurality of coupling teeth are arranged in circles about the axial aperture, each coupling tooth provided with a hooking face and a slope. The disadvantages of this patent are: the operator needs to press the button at a certain speed to ignite, which is not easy; the lighter has a complex structure and requires too high a level of precision on the parts, which raises the manufacturing cost.

Chinese Patent No. 97226690.9 discloses a gaseous fuel lighter, which includes a sealed oil tank, an outlet device, and an ignition device that relies on frictional interactions between a steel wheel and a flint for spark generation. The steel wheel is driven by a connecting rod actuated by a button; the connecting rod in turn drives the steel wheel cover and a pawl; in the end, the pawl toggles a ratchet and the steel wheel to turn. Additional accessories include a linking spring underneath the button, a reset spring, guideposts for the connecting rod, and an elastic slider. This plan is also overly complicated with complex accessories, and the degree of precision required of the accessories is too high for mass production.

Chinese Patent No. 95243330.3 discloses a vertical pressing ignition device that uses a steel wheel, which includes a seat frame, a steel wheel, and a flint. On the seat frame, there is an actuation apparatus that includes a button, a pressurized spring, a return spring, a rotating rod, and a pressurizing buckle; the steel wheel is equipped with a steel wheel cover. This plan is also overly complicated, the degree of precision required of the accessories too high, which makes the actual implementation very difficult and highly unstable.

Therefore, the industry needs to solve the problem of how to provide the kind of push-button type flint ignition lighter that truly takes advantages of flint ignition mechanisms' superior tactile feel, simple construction, low cost, cleanliness and good sanitation, and indeed its ability to be put to actual mass production.

DESCRIPTION OF THE INVENTION

To overcome disadvantages of the prior art, the object of the present invention is to take advantage of flint ignition mechanism's innate features, for a simpler and cleaner way to ignite the flint lighter; furthermore, the push-button flint ignition mechanism according to the present invention not only provides a flint lighter a tactile feel almost identical to that of an electronic lighter, but also embodiments that are very simple, require few parts, with low degree of precision required of the parts, low in manufacturing costs, and easy to mass produce.

In order to achieve the above objectives, the present invention provides a push-button type flint ignition mechanism that is capable of automatic reset; the mechanism includes: a built-in flint, a grinding wheel abutting the flint, an energy storage member that stores energy through deformation, a driving wheel rotating in the same direction as the grinding wheel when the energy storage member releases energy, a wheel axle around which the driving wheel rotates, a driving body pushed by the energy storage member when the energy storage member releases energy, a plucking portion located on the driving body and capable of plucking the driving wheel to make the driving wheel rotate, a blocking member capable of blocking the movement of the driving body, a moving member capable of making linear movements back and forth inside the mechanism and capable of squeezing the energy storage member to cause elastic deformation in the latter, and a reset member capable of pushing the moving member to reset, wherein when no external force is exerted on the mechanism, the projections of the plucking portion and the driving wheel, respectively onto the plane perpendicular to the direction of movement by the moving member, do not overlap.

Moreover, and optionally, when the energy storage member finishes releasing energy, the projections of the plucking portion and the driving wheel, respectively onto the plane perpendicular to the direction of movement by the moving member, do not overlap.

In the present invention, the energy storage member and the reset member can be all kinds of parts that store energy through deformation, for example, various springs, in particular, they can be torsion springs, compression springs or extension springs.

According to an embodiment of the present invention, the driving body is integrally formed.

In accordance with another embodiment of the present invention, the driving body may be elastically deformable.

In accordance with another embodiment of the present invention, the driving body consists of two parts.

In accordance with another embodiment of the present invention, the driving body consists of two parts that are connected together through a rotating axle.

In accordance with another embodiment of the present invention, the driving wheel is a spur gear, a non-spur gear, a ratchet gear, and so on.

In accordance with another embodiment of the present invention, the plucking portion comprises: one or more teeth to engage the driving wheel, a pawl, or part(s) with a flat surface that contacts the driving wheel where the material of the surface is rubber, silicone rubber, or other suitable elastomeric material.

In accordance with another embodiment of the present invention, the grinding wheel and the driving wheel are integrally formed, and the overall appearance and structure are similar to those of a conventional grinding wheel.

In accordance with another embodiment of the present invention, the blocking member is not elastically deformable.

In accordance with another embodiment of the present invention, the blocking member is elastically deformable.

In accordance with yet another embodiment of the present invention, the driving body includes an elastically deformable part that can hold off the blocking member.

In accordance with another embodiment of the present invention, the way that the plucking portion moves closer to the driving wheel when the moving member presses on the driving body is accomplished through movement of the plucking portion from a side close to the moving member to a side close to the driving wheel.

In accordance with another embodiment of the present invention, the way that the plucking portion moves closer to the driving wheel when the moving member presses on the driving body is accomplished through movement of the plucking portion from a side close to the grinding wheel to a side close to the driving wheel.

In accordance with another embodiment of the present invention, the way that the plucking portion moves closer to the driving wheel when the moving member presses on the driving body is accomplished through movement of the plucking portion from a location distant from the driving wheel to a location close to the driving wheel through rotation about an axis made up by the direction of movement by the moving member.

In accordance with another embodiment of the present invention, the ignition mechanism and a gas-control lever together form an assembly (alternatively, the assembly may not include the gas-control lever).

In accordance with another embodiment of the present invention, an assembly may be first assembled with a push-button, a wind shield, a housing, a valve and other parts, and then charged with fuel to yield a complete lighter.

In accordance with another embodiment of the present invention, in order to produce a spark using the ignition mechanism, the operator needs to apply a lot of force—this setup is to prevent children from lighting fires too easily.

In accordance with another embodiment of the present invention, the grinding wheel, the driving wheel, and the wheel axle are integrally formed.

In accordance with another embodiment of the present invention, the grinding wheel and the driving wheel are integrally formed, and the wheel blank, before it is rolling-carved to have any thread lines or chopped to have any spark-generating filing-tooth, is only made using cold heading techniques.

The push-button flint ignition mechanism of the present invention may be used to generate sparks in, for example, cigarette lighter or utility lighter. However, other applications and implementations of the flint ignition mechanism are also within the scope of the present invention.

Compared to the prior art, the present invention has the following beneficial effects:

1. After taking the unique features of the flint ignition mechanism into full consideration, the present invention arrives at the most reliable, high ignition-rate ignition mechanism using the simplest, most rational structural layout, the least amount of parts, and at the lowest cost.

2. An operator operating a lighter containing the ignition mechanism according to the present invention does not need to contact the grinding wheel, and operates the lighter almost in the same manner as one does an electronic lighter: with good tactile feel, clean and sanitary.

3. Because the production cost for the flint ignition mechanism of the present invention is lower than that of the piezoelectric ignition mechanism that an electronic lighter must use, a lighter using the present invention is less costly.

4. None of the parts for the present invention require high levels of manufacturing skills or precision, making it easy for mass production.

5. The flint ignition mechanism of the present invention can be used in child-safe lighters that are designed to protect children's safety; its ease of manufacture, at no additional cost, and predictable popularity, will enable better protection of more children.

The present invention is further described hereinafter with reference to accompanying drawings.

SPECIFIC EMBODIMENTS

Example 1

Figure 1:
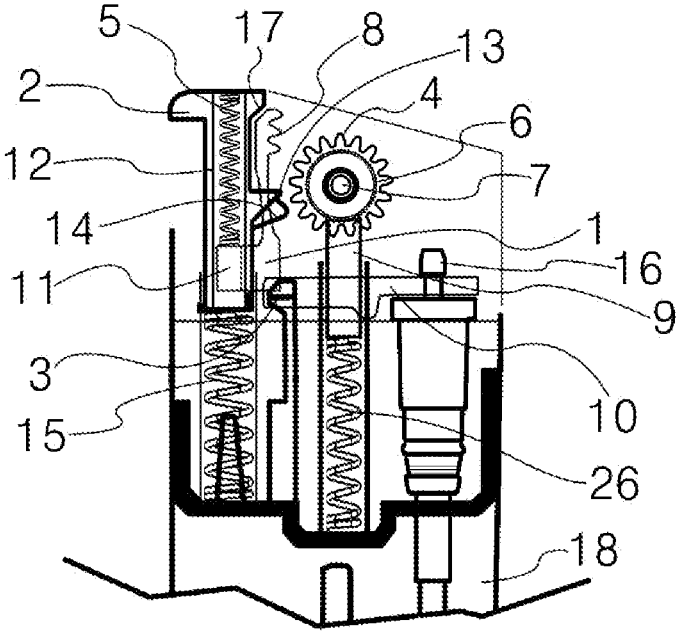
FIG. 1 is an illustration of the interior structure of Example 1, which shows the state of various components of the ignition mechanism when no external force is applied to the mechanism.

As shown in FIG. 1, in the present exemplary embodiment, the driving body 1 is made from plastic (or other suitable materials) and integrally formed.

The lighter includes an ignition mechanism, a gas fuel storage mechanism 18, a valve 16 that controls fuel release, and a gas-control lever 10 that can open the valve 16. The ignition mechanism includes a driving body 1, an energy storage member 5, a moving member 2, a blocking member 3, a reset member 15, a flint 9, a flint spring 26, a wheel axle 7, a grinding wheel 6 and a driving wheel 4, where both the grinding wheel 6 and the driving wheel 4 can rotate synchronously about the wheel axle 7.

Among the various components: the flint spring 26 is biased to push the flint 9 against the grinding wheel 6; the driving wheel 4 is a spur gear; a plucking portion 8 of the driving body 1 consists of three teeth that can engage those on the driving wheel 4; the driving body 1 is elastically deformable; the driving body 1 is equipped with a slider 11 that can slide up and down inside a groove 12 that is situated in the moving member 2; the moving member 2 can slide up and down in the ignition mechanism; the energy storage member 5 is a compression spring; the upper end of the energy storage member 5 is biased to hold against the moving member 2, while its lower end is biased to hold against the driving body 1; the elastically deformable blocking member 3 is immobilized inside the ignition mechanism underneath the driving body 1; the reset member 15 is a compression spring; the reset member 15 is biased to hold against the moving member 2.

Figure 2:
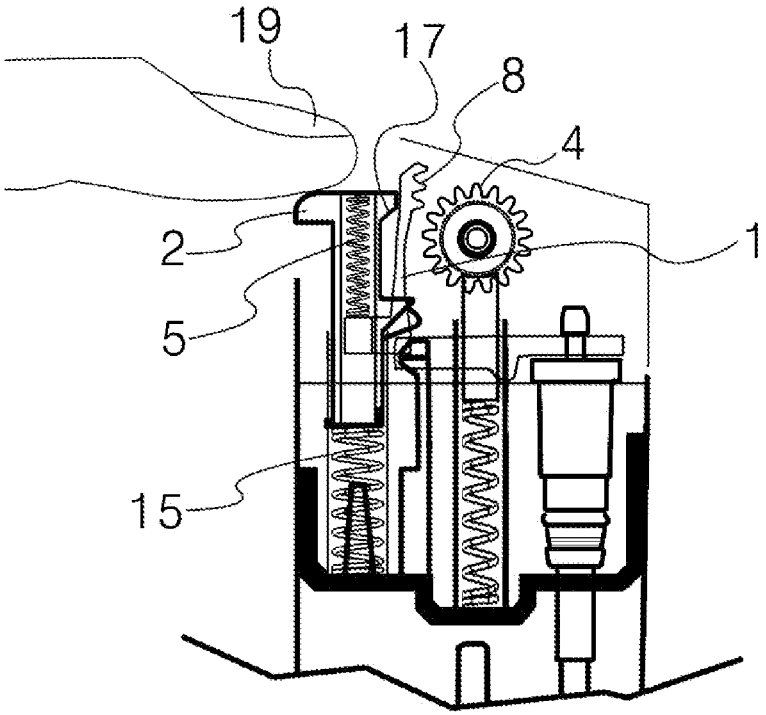
FIG. 2 is an illustration of the interior structures of Example 1 and Example 11, showing that a hand presses on a moving member, causing the latter to move downward, squeezing the driving body, and the plucking portion moving near the side of the driving wheel.

When a hand 19 presses down on the moving member 2 (as shown in FIG. 2), the moving member 2 slides downward and compresses the energy storage member 5 to store energy therein due to compression; the blocking member 3 stops the driving body 1 from moving downward. At the same time, a sloped surface 17 on the moving member 2 forces the driving body 1 to elastically deflect. As a result, the plucking portion 8 on the driving body 1 moves closer to the side of the driving wheel 4, while the moving member 2 compresses the reset member 15 to store energy therein due to compression.

Figure 3:
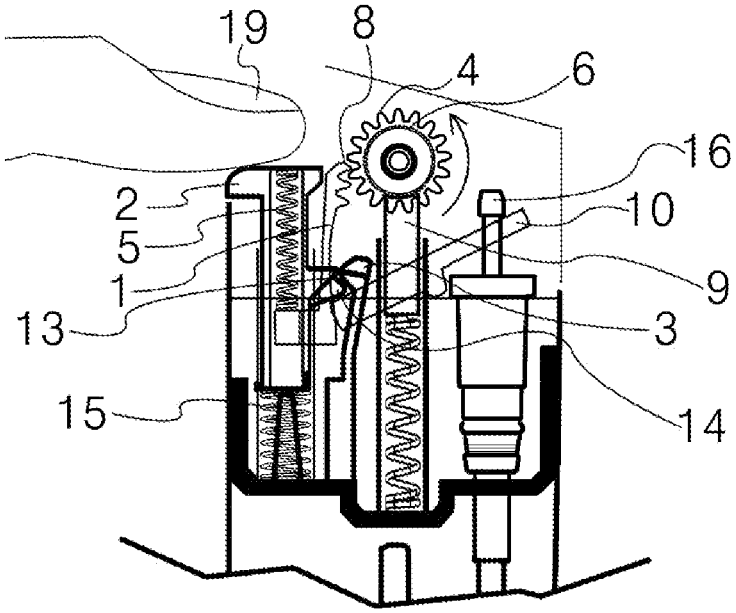
FIG. 3 is an illustration of the interior structures of Example 1, showing: as the hand continues to exert pressure, the moving member presses on the gas-control lever, opening the valve to release gas; also, the moving member pushes away the blocking member so that the blocking member no longer blocks the driving body; a sudden release of energy from the energy storage member pushes the driving body downward; the plucking portion plucks the driving wheel to rotate, and the grinding wheel also rotates in the same direction.

When the hand 19 continues to press down on the moving member 2 (as shown in FIG. 3), a second press portion 14 on the moving member 2 will press on the gas-control lever 10, causing the gas-control lever 10 to rotate and open the valve 16 to start to release the gas fuel. In addition, when the moving member 2 moves down to a preset position, a first press portion 13 on the moving member 2 will force the blocking member 3 to elastically deflect, so that the blocking member 3 is no longer blocking the driving body 1; the energy storage member 5 will suddenly release energy and push the driving body 1 downward; the plucking portion 8 of the driving body 1 in turn plucks the driving wheel 4 to rotate; the grinding wheel 6 simultaneously turns and frictionally engages the flint 9 to generate a spark that ignites the gas fuel.

Figure 4:
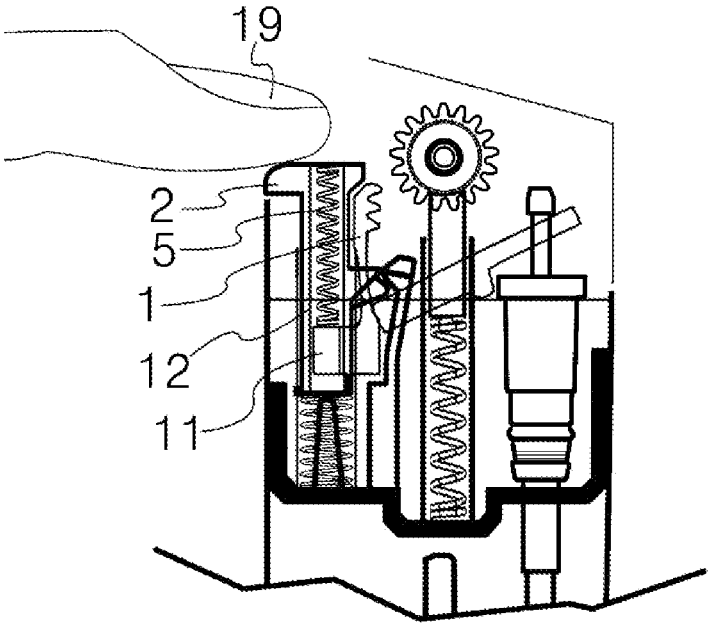
FIG. 4 is an illustration of the interior structure of Example 1, showing: when the slider of the driving body slides to the farthest point that it can slide down in the groove, the driving body recovers from the elastic deformation caused by being pressed upon by the moving member; the plucking portion automatically moves away from the side of the driving wheel.

When the slider 11 of the driving body 1 slides to the farthest point that it can slide down in the groove 12 (as shown in FIG. 4), the energy storage member 5 finishes the release of energy; the relative positions between the driving body 1 and the moving member 2 are the same as when no external force is applied to the ignition mechanism; the driving body 1 recovers from the elastic deformation that resulted from being deflected by the moving member 2; and accordingly, the plucking portion 8 is away from the side of the driving wheel 4.

When the hand 19 is no longer pressing on the moving member 2, the reset member 15 pushes the moving member 2 to slide upward; the driving body 1 moves upward at the same time and does not contact the driving wheel 4; all components reset, the valve 16 no longer releases gas fuel, and the flame is extinguished (see FIG. 1).

Example 2

Figure 5:
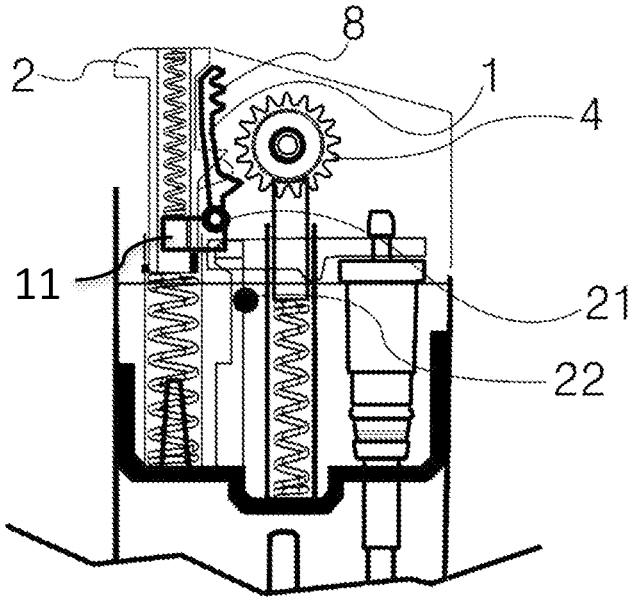
FIG. 5 is an illustration of the interior structure of Example 2, which shows the state of various components of the ignition mechanism when no external force is applied to the mechanism.

As shown in FIG. 5, the operating principles of the present embodiment are almost identical to the ones shown in Example 1.

However, the present embodiment differs from Example 1 as follows:

1) Driving body 1 consists of two components that are coupled together through a pivot 21.

2) A blocker 22 is fixed inside the ignition mechanism.

3) Driving wheel 4 is a gear, but not a spur gear.

Figure 6:
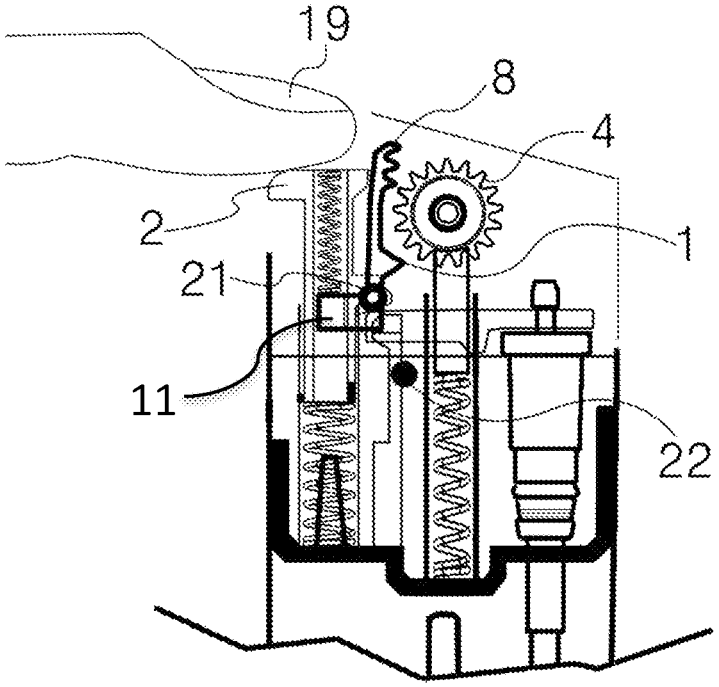
FIG. 6 is an illustration of the interior structures of Example 2, showing that a hand applies pressure on a moving member to force it to move downward and squeeze the driving body, and making the plucking portion rotate about the pivot and move closer to the side of the driving wheel.
Figure 7:
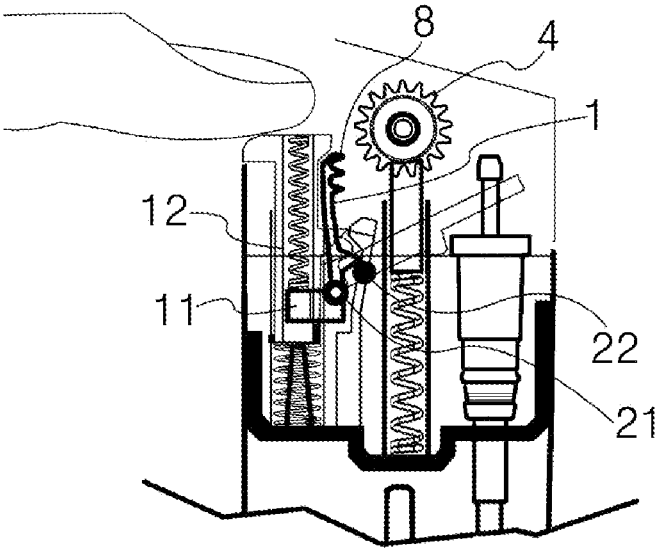
FIG. 7 is an illustration of the interior structures of Example 2, showing: as the hand continues to exert pressure, and when the slider of the driving body slides to the farthest point that it can slide down in the groove, the driving body will be pushed against the blocker, causing the plucking portion to rotate back about its pivot and move away from the side of the driving wheel.

4) During the period when the hand 19 is pressing down on the moving member 2, the moving member 2 will apply force on the driving body 1 leading the plucking portion 8 to rotate about the pivot 21 and move close to the side of the driving wheel 4 as a result (see, FIG. 6); when the energy storage member 5 releases energy and pushes the slider 11 on the driving body 1 to slide to the farthest point that it can slide down in the groove 12, the driving body 1 will be pushed against the blocker 22 making the plucking portion 8 rotate backward about the pivot 21, and move away from the side of the driving wheel 4 as a result (see, FIG. 7).

Moreover, during the reset process, the plucking portion 8, as in Example 1, does not touch the driving wheel 4.

Example 3

Figure 8:
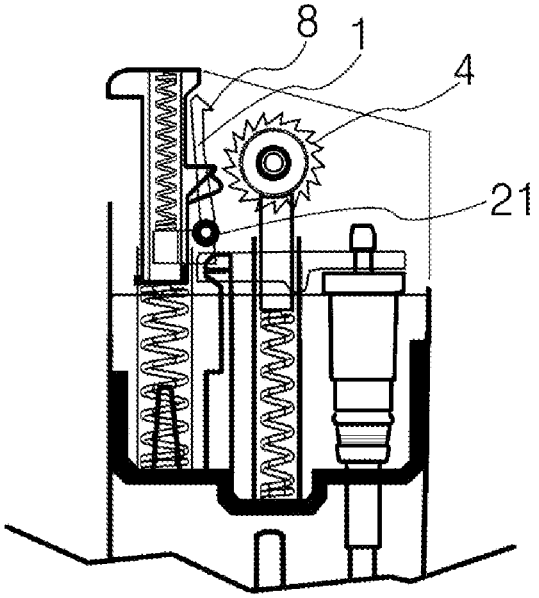
FIG. 8 is an illustration of the interior structure of Example 3, which shows the state of various components of the ignition mechanism when no external force is applied to the mechanism.

As shown in FIG. 8, the operating principles of the present embodiment differ from Example 2 mainly as follows:

1) The amount of rotation between the two components of the drive body 1 is limited.

2) There is no blocker 22 that is found in Example 2.

3) Driving wheel 4 is a ratchet gear, and the plucking portion 8 is a pawl that can pluck the ratchet gear to rotate.

4) During the reset process, the plucking portion 8 will encounter the driving wheel 4 and immediately turn about the pivot 21 backward to avoid being blocked by the driving wheel 4.

The rest in this exemplary embodiment is the same as in Example 2.

Example 4

Figure 9:
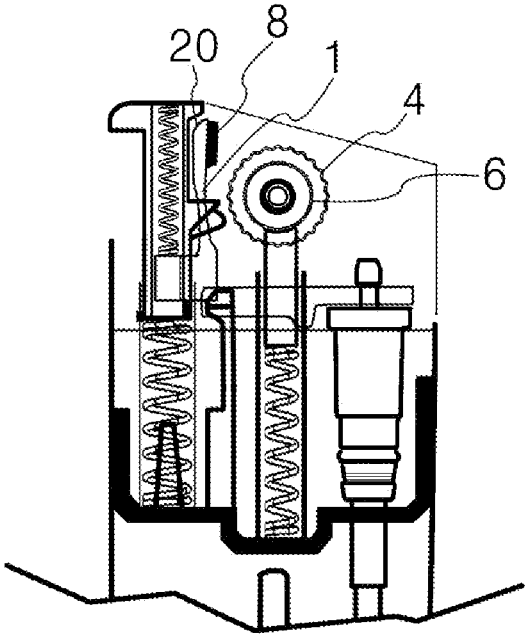
FIG. 9 is an illustration of the interior structure of Example 4, which shows the state of various components of the ignition mechanism when no external force is applied to the mechanism.

As shown in FIG. 9, the present embodiment mainly differs from the one shown in Example 1 as follow:

1) The plucking portion 8, unlike in the above embodiments, does not have teeth that engage the driving wheel 4, rather, it has a flat surface that contacts the driving wheel 4 where the plucking surface part is made of rubber, silicone rubber, or other suitable elastomeric materials; except for the plucking portion 8, parts in the driving body 1 are made of plastics different from the material for the plucking portion 8.

2) The plucking portion 8 rotates the driving wheel 4 through frictional forces.

3) The driving wheel 4 is not a spur gear.

4) On the driving body 1 where it contacts the moving member 2, there is a curved surface 20.

The remaining operational principles and processes are the same as in Example 1.

Example 5

Figure 10:
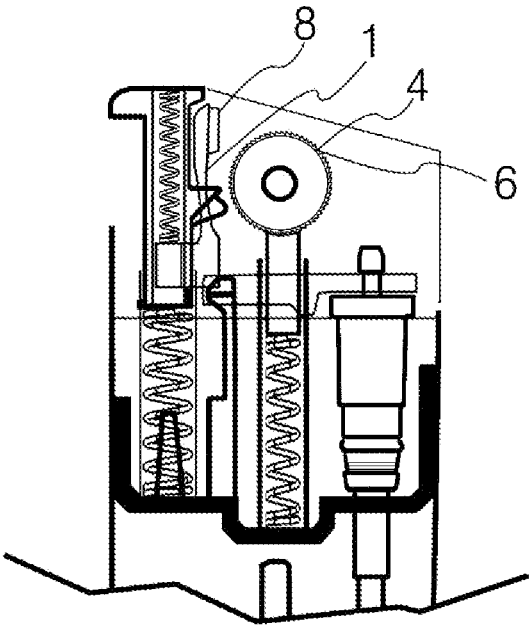
FIG. 10 is an illustration of the interior structure of Example 5, which shows the state of various components of the ignition mechanism when no external force is applied to the mechanism.
Figure 11:
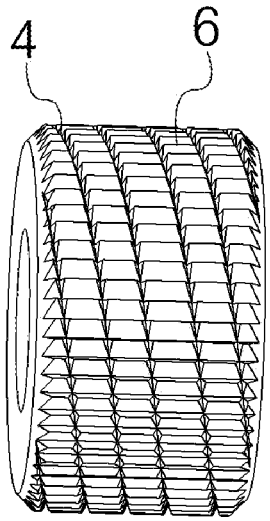
FIG. 11 is a perspective illustration of the integrally formed grinding wheel and driving wheel of Example 5, the overall appearance and overall structure being the same as a conventional grinding wheel.
Figure 12:
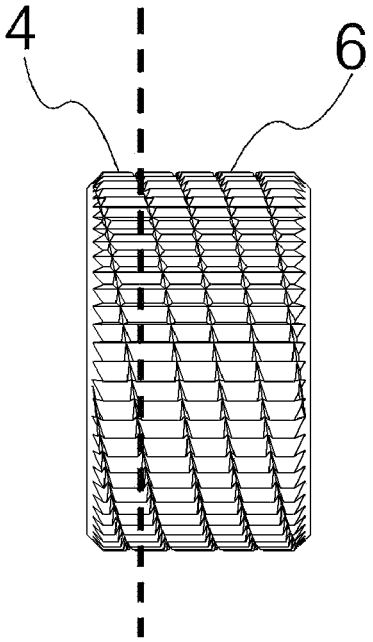
FIG. 12 is a perspective illustration of the integrally formed grinding wheel and driving wheel of Example 5, which shows that the left side to the dashed line is the driving wheel, and the right side to the dashed line is the grinding wheel.

As shown in FIG. 10, the present example is different from Example 4 as follows:

1) The grinding wheel 6 and the driving wheel 4 are integrally formed, and the overall appearance and overall structure of the resulting piece look no different from a conventional grinding wheel (as shown in FIG. 11). As shown in FIG. 12, the illustrated piece appears to be a conventional grinding wheel, but in fact the left side to the dashed line is a driving wheel 4, the right side to the dashed line is a grinding wheel 6, the two being integrally formed, and the overall appearance and overall structure appear no different from a conventional grinding wheel.

2) The driving body 1 is formed integrally; the material is rubber, silicone rubber, or other suitable elastomeric materials.

3) The plucking portion 8 also rotates the grinding wheel 6 when rotating the driving wheel 4.

The rest in this exemplary embodiment are the same as in Example 4.

Example 6

Figure 13:
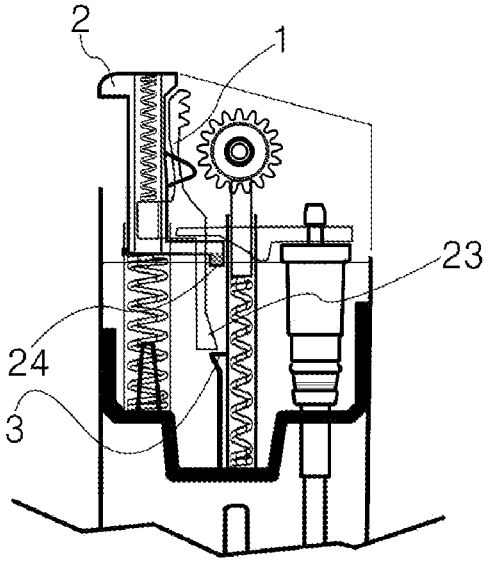
FIG. 13 is an illustration of the interior structure of Example 6, which shows the state of various components of the ignition mechanism when no external force is applied to the mechanism.

As shown in FIG. 13, the operating principles of the present embodiment differ from Example 1 mainly as follows:

1) The blocking member 3, which is fixed inside the ignition mechanism, is not elastically deformable.

2) The driving body 1 includes an elastic portion 23 that is elastically deformable and can be used to hold off the blocking member 3.

3) The moving member 2 has a push block 24 for interacting with the elastic portion.

4) The moving member 2 does not have the first press portion 13 to interact with the blocking member.

Figure 14:
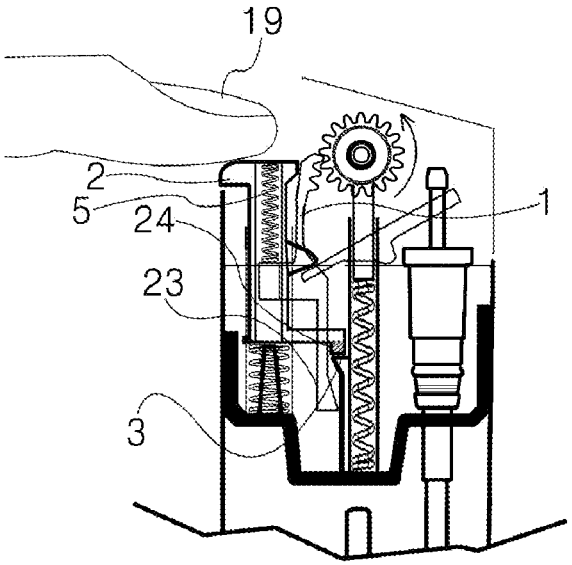
FIG. 14 is an illustration of the interior structures of Example 6, showing: as the hand exerts pressure, the moving member presses on the gas-control lever, opening the valve to release gas; and the moving member pushes away the elastic part of the driving body, resulting in the driving body getting around the blocking member; a sudden release of energy from the energy storage member pushes the driving body downward; the plucking portion plucks the driving wheel to rotate, and the grinding wheel also rotates in the same direction.

5) When the hand 19 presses down the moving member 2, the push block 24 on the moving member 2 will cause the elastic portion 23 to elastically deflect by squeezing down on it, enabling the driving body 1 to get around the barricade of the blocking member 3, which in turn causes the energy storage member 5 to release energy and to push the driving body 1 downward (as shown in FIG. 14). Once reset, the elastic portion 23 will recover from the elastic deflection (as in FIG. 13).

The rest of the principles are the same as in Example 1.

Example 7

Figure 15:
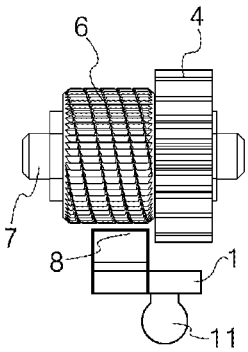
FIG. 15 is a top view of four components inside the ignition mechanism of Example 7: the grinding wheel, the driving wheel, the driving body, and the wheel axle, showing the spatial relationship among the three components—the grinding wheel, the driving wheel and the plucking portion—when no external force is applied to the ignition mechanism.
Figure 16:
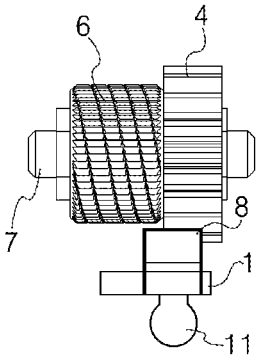
FIG. 16 is a top view of four components inside the ignition mechanism of Example 7: the grinding wheel, the driving wheel, the driving body, and the wheel axle, and shows how the plucking portion moves from near the side of the grinding wheel to near the side of the driving wheel as a result of the moving member pressing on the driving body.

As shown in FIG. 15, this top view shows the spatial relationship among the plucking portion 8, the grinding wheel 6, and the driving wheel 4 when no external force is applied to the ignition mechanism. The present example illustrates that, besides the way where the plucking portion 8 is moved close to the driving wheel 4 as a result of the moving member 2 pushing or forcing the driving body 1, as mentioned in all the above examples, the plucking portion 8 may also be moved from the side near the grinding wheel 6 to the side near the driving wheel 4 (as in FIG. 16).

Example 8

Figure 17:
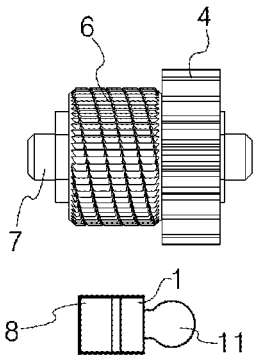
FIG. 17 is a top view of four components inside the ignition mechanism of Example 8: the grinding wheel, the driving wheel, the driving body, and the wheel axle, showing the spatial relationship among the three components—the grinding wheel, the driving wheel and the plucking portion—when no external force is applied to the ignition mechanism.
Figure 18:
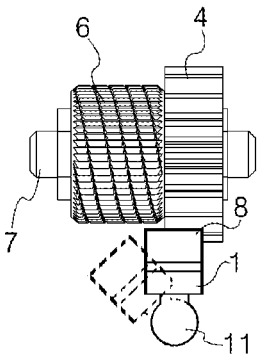
FIG. 18 is a top view of four components inside the ignition mechanism of Example 8: the grinding wheel, the driving wheel, the driving body, and the wheel axle, and shows how the plucking portion moves from a position away from the side of the driving wheel to a position near the side of the driving wheel through rotation about an axis that is the direction of movement by the moving member.

As shown in FIG. 17, this top view shows the spatial relationship among the plucking portion 8, the grinding wheel 6, and the driving wheel 4 when no external force is applied to the ignition mechanism. The present example illustrates that, besides the way where the plucking portion 8 is moved close to the driving wheel 4 as a result of the moving member 2 pushing or forcing the driving body 1, as mentioned in all the above examples, the plucking portion 8 may also be moved to the position close to the driving wheel 4 from a position distant from the driving wheel 4 through rotating about an axis that is the direction of movement by the moving member 2 (as in FIG. 18).

Example 9

Figure 19:
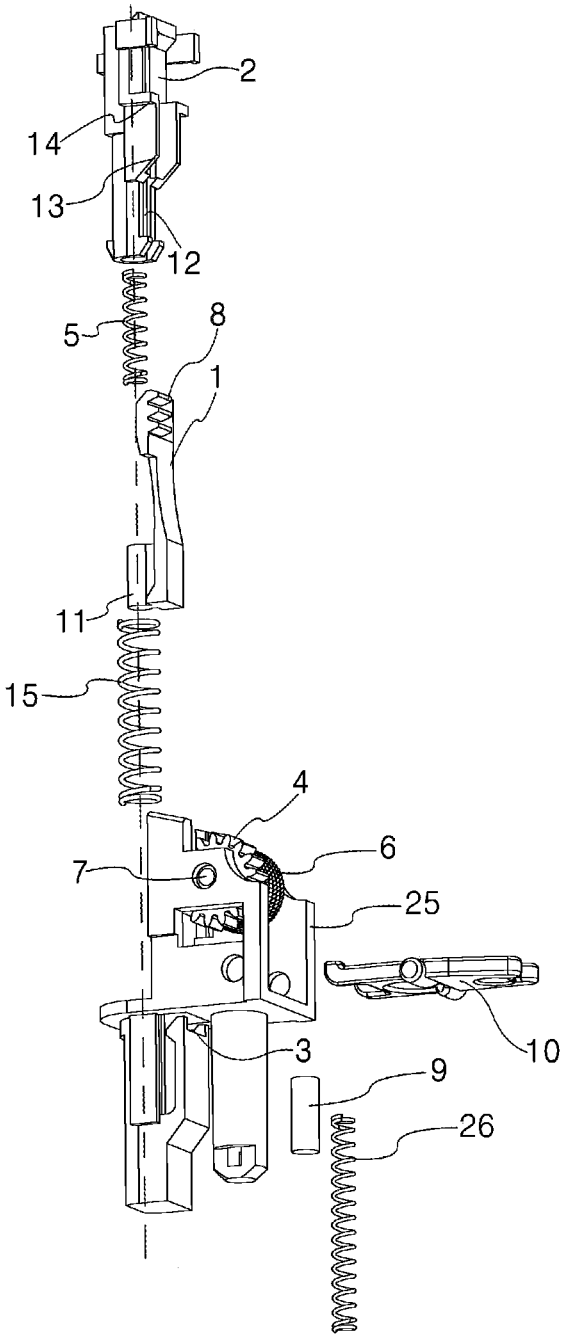
FIGS. 19 and 20 are both exploded views of Example 9, showing various components that form the assembly.
Figure 20:
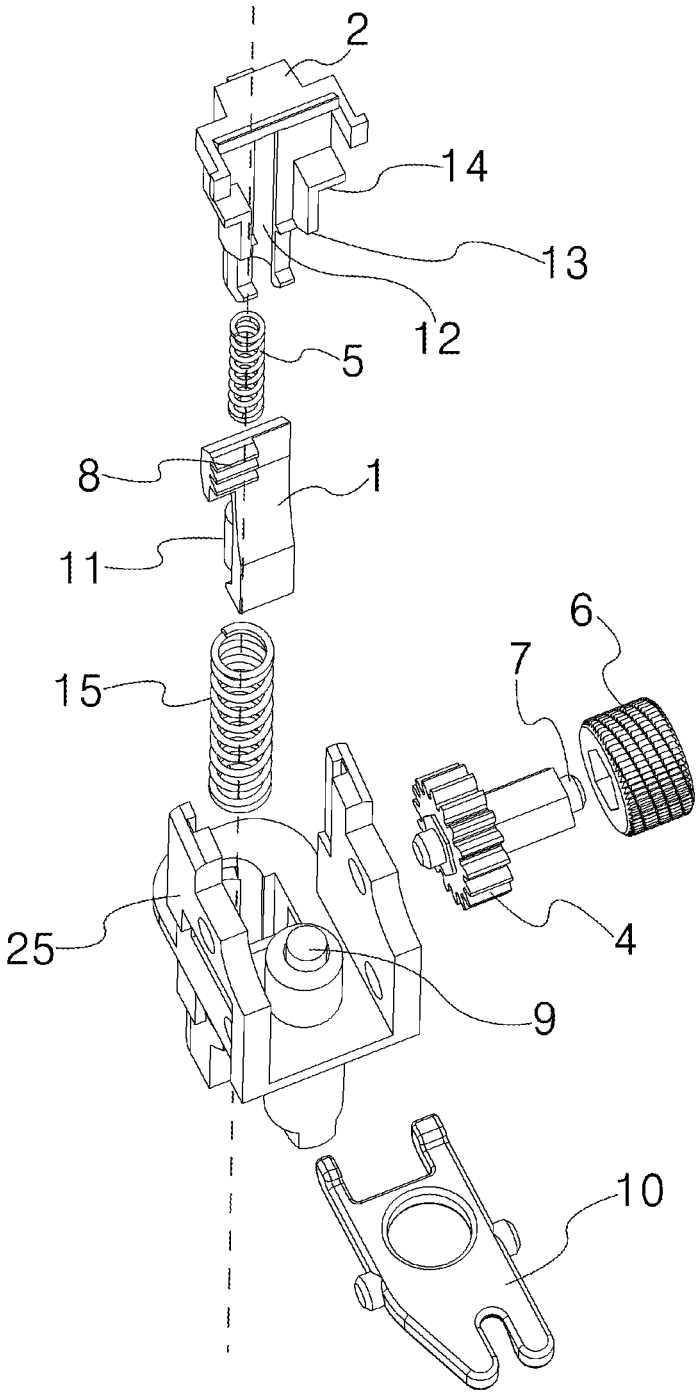
Figure 21:
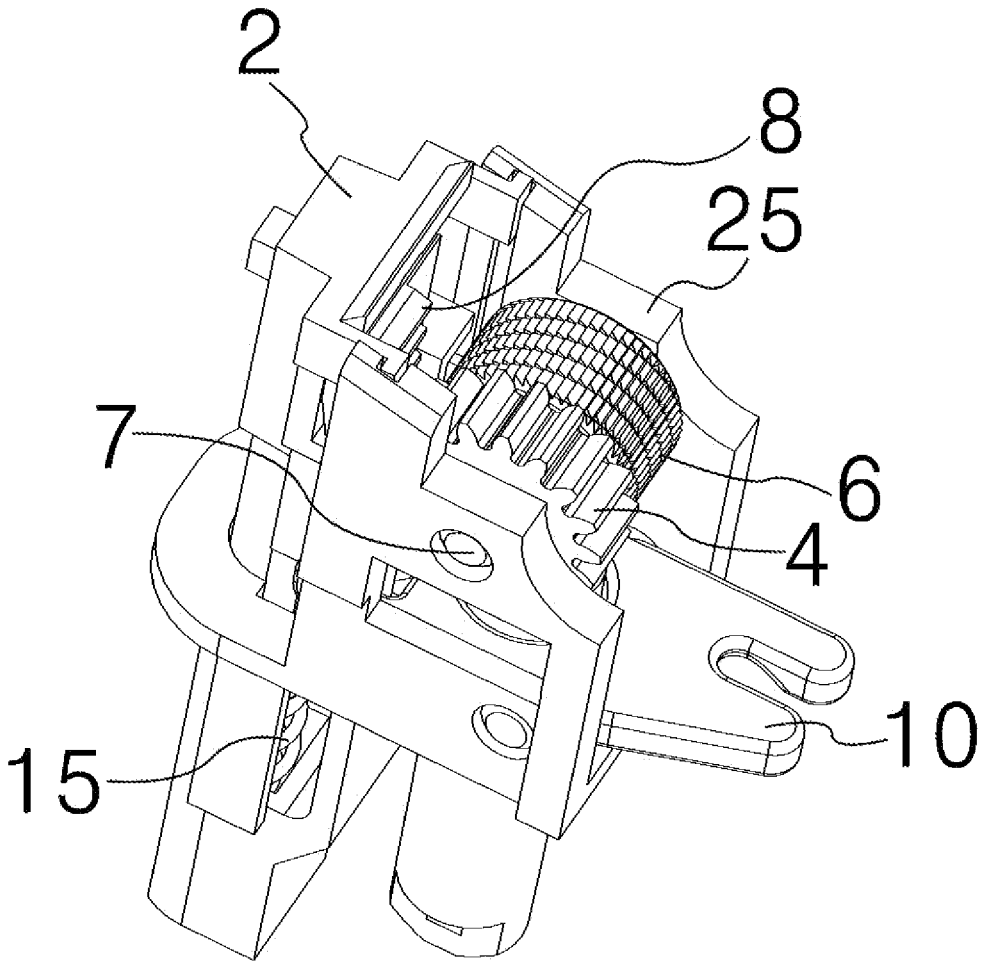
FIG. 21 is a perspective illustration of Example 9.

As shown in FIGS. 19, 20, and 21, an ignition mechanism including the driving body 1, the moving member 2, the energy storage member 5, the reset member 15, a frame 25, the driving wheel 4, the grinding wheel 6, the wheel axle 7, the flint 9, and the flint spring 26, forms an assembly 27 with the gas-control lever 10.

Amongst the components, the driving wheel 4 and the wheel axle 7 are formed integrally, while the blocking member 3 is on the frame 25.

The present embodiment's structural principles are the same as in Example 1.

Moreover, in an alternate embodiment, the assembly 27 does not include the gas-control lever 10.

Example 10

Figure 22:
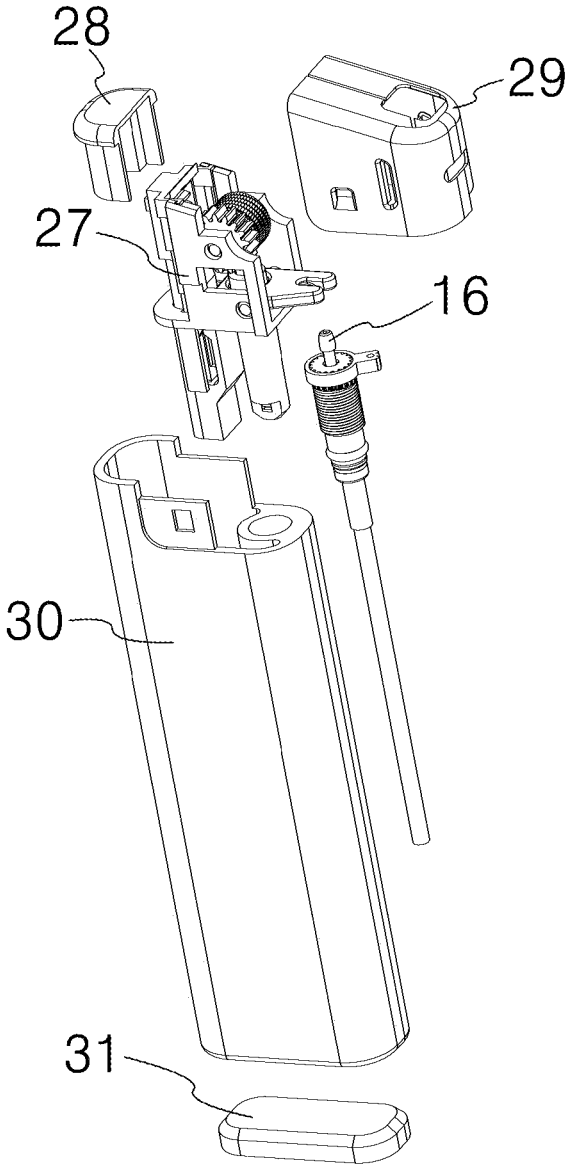
FIG. 22 is an exploded view of Example 10.
Figure 23:
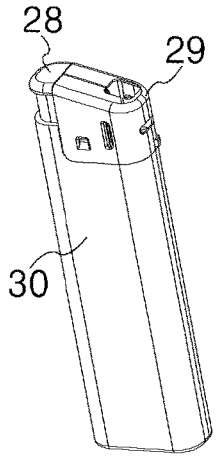
FIG. 23 is a perspective illustration of Example 10.

As shown in FIG. 22, once the assembly 27 and parts such as a button 28, a wind shield 29, a housing 30, a valve 16, a bottom cover 31, and so on, are all assembled and then charged with fuel, a complete lighter is produced (e.g., FIG. 23).

This embodiment is meant to be merely illustrative of possible applications for the assembly 27, the parts, structure and types of lighters applicable for the present invention should not be limited to this embodiment.

Example 11

As shown in FIG. 2, the recoil strength of the energy storage member 5 and/or of the reset member 15 is very strong, making a child unable to press the moving member 2 to a pre-set position that would result in spark generation, therefore preventing the ignition mechanism from igniting. This setup is to prevent children from lighting up a fire too easily.

Figure 24:
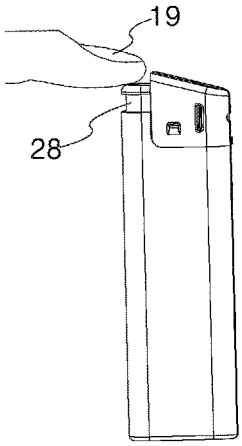
FIG. 24 is a perspective illustration of Example 11, showing one hand in the act of pressing the push-button of the ignition mechanism.

And as shown in FIG. 24, the ignition mechanism shown here is the one featured in Example 10: in the assembly 27, the recoil strength of the energy storage member 5 and/or of the reset member 15 is very strong. As a result, when a child presses the button 28, he should not be able to force the moving member 2 downward to a position that can result in spark generation, therefore preventing the ignition mechanism from igniting. This setup is similarly aimed at preventing children from lighting up a fire too easily.

Example 12

Figure 25:
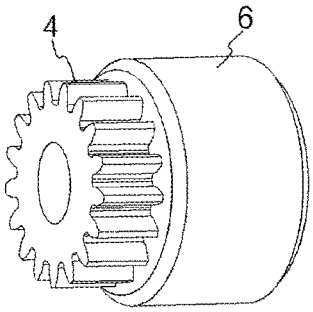
FIG. 25 is a perspective illustration of Example 12, which shows an integrally formed wheel blank consisting of the driving wheel and the grinding wheel (without either the thread lines or spark-generating filing-teeth).
Figure 26:
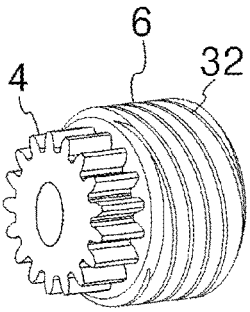
FIG. 26 is a perspective illustration of Example 12, which shows an integrally formed semi-finished article consisting of the driving wheel and the grinding wheel (carved with thread lines but not yet with spark-generating filing-teeth).
Figure 27:
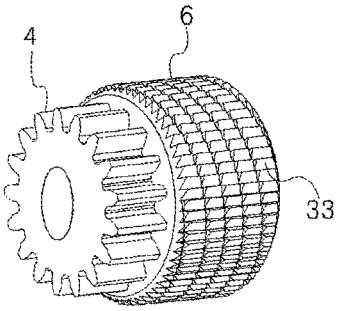
FIG. 27 is a perspective illustration of Example 12, which shows an integrally formed finished article consisting of the driving wheel and the grinding wheel (carved with thread lines and chopped with spark-generating filing-teeth).

As shown in FIG. 25, the driving wheel 4 and the grinding wheel 6 are integrally formed, where the wheel blank not yet rolling-carved with thread lines 32 and not yet chopped with the spark-generating filing-teeth 33 is first made exclusively with the cold heading techniques. Then, thread lines 32 are rolling-carved onto the wheel blank (as shown in FIG. 26), chopped with spark-generating filing-teeth 33, and finally finished with heat treatment and other steps, to arrive at a final product (as shown in FIG. 27).

Example 13

Figure 28:
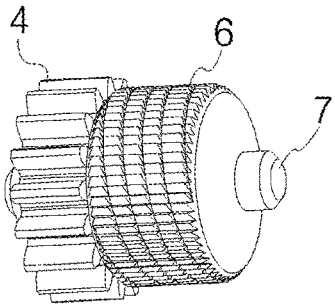
FIG. 28 is a perspective illustration of Example 13, showing an integrally formed article consisting of the driving wheel, the grinding wheel and the wheel axle, where the driving wheel has an outer diameter greater than that of the grinding wheel.
Figure 29:
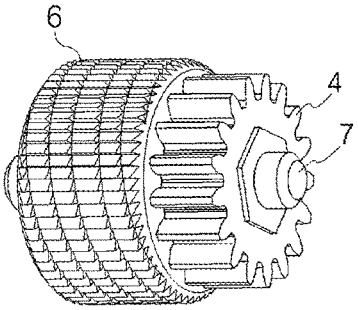
FIG. 29 is a perspective illustration of Example 13, showing an integrally formed article consisting of the driving wheel, the grinding wheel and the wheel axle, where the driving wheel has an outer diameter smaller than that of the grinding wheel.
Figure 30:
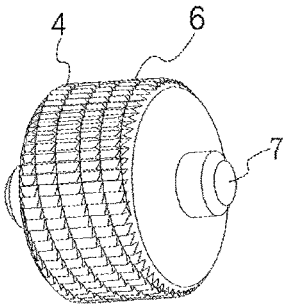
FIG. 30 is a perspective illustration of Example 13, showing an integrally formed article consisting of the driving wheel, the grinding wheel and the wheel axle, where the exteriors of the driving wheel and the grinding wheel are combined into a single unit.

As shown in FIG. 28, the grinding wheel 6, the driving wheel 4 and the wheel axle 7 are integrally formed. The outer diameter of the driving wheel can be larger than that of the grinding wheel 6, or can be smaller than that of the grinding wheel 6 (as in FIG. 29), or the two outer diameters can be the same. Further, the exteriors of the driving wheel 4 and the grinding wheel 6 can also be combined into a single unit (as shown in FIG. 30).

Although the present invention is disclosed using preferred exemplary embodiments above, the scope of the present invention is not limited to these examples. Any person of ordinary skills in the art, without departing from the spirit of the present invention, should be allowed some room for modifications, i.e., any equivalent improvements based on the present invention should be covered within the scope of the present invention.

The invention claimed is:

1. A push-button type flint ignition mechanism configured for automatic reset after each actuation motion, the mechanism comprising: a built-in flint, a grinding wheel abutting the flint, an energy storage member that stores energy through deformation, a driving wheel rotating in the same direction as the grinding wheel when the energy storage member releases energy, a wheel axle about which both the driving wheel and the grinding wheel rotate, a driving body configured to be pushed by the energy storage member when the energy storage member releases energy causing the driving body to actuate the driving wheel, through a plucking portion located on the driving body that plucks the driving wheel to rotate thereby bringing the grinding wheel to rotate about the wheel axle and frictionally engage the flint to generate at least a spark, a blocking member disposed proximate to the driving body and configured to temporarily block the movement of the driving body before the energy storage member releases energy, a moving member configured to make movements back and forth inside the mechanism, to squeeze the energy storage member to cause elastic deformation in the latter, and to disable the blocking member from blocking the driving body, and a reset member configured to push the moving member to initiate a reset motion, wherein, at the start of each reset motion, projections of the plucking portion and the driving wheel, respectively onto a plane perpendicular to the direction of movement by the moving member, do not overlap, and the plucking portion does not contact the driving wheel during the reset motion.

2. The push-button type flint ignition mechanism of claim 1, wherein, at the start of each actuation motion, the projections of the plucking portion and the driving wheel, respectively onto the plane perpendicular to the direction of movement by the moving member, do not overlap.

3. The push-button type flint ignition mechanism of claim 1, wherein the driving body is formed as a single unit.

4. The push-button type flint ignition mechanism of claim 3, wherein the driving body is elastically deformable.

5. The push-button type flint ignition mechanism of claim 1, wherein the driving body comprises two components coupled together such that they flex from each other.

6. The push-button type flint ignition mechanism of claim 5, wherein the two components of the driving body are connected through a pivot.

7. The push-button type flint ignition mechanism of claim 1, wherein the blocking member is fixed inside the mechanism.

8. The push-button type flint ignition mechanism of claim 7, wherein the blocking member is elastically deformable.

9. The push-button type flint ignition mechanism of claim 1, wherein contact surfaces between the moving member and the driving body comprise a sloped or curved surface.

10. The push-button type flint ignition mechanism of claim 1, wherein the driving wheel is spur gear.

11. The push-button type flint ignition mechanism of claim 1, wherein the grinding wheel and the driving wheel are integrally formed into a single unit similar to a conventional grinding wheel in overall structure.

12. The push-button type flint ignition mechanism of claim 1, wherein the grinding wheel, the driving wheel, and the wheel axle are integrally formed.

13. The push-button type flint ignition mechanism of claim 1, being part of a cigarette lighter or utility lighter and further comprising a fuel storage and release mechanism configured to release fuel during an actuation motion such that the spark generated is used to light a flame.

14. The push-button type flint ignition mechanism of claim 2, wherein the driving body is formed as a single unit.

15. The push-button type flint ignition mechanism of claim 14, wherein the driving body is elastically deformable.

16. The push-button type flint ignition mechanism of claim 2, wherein the driving body comprises two components coupled together such that they flex from each other.

17. The push-button type flint ignition mechanism of claim 16, wherein the two components of the driving body are connected through a pivot.

18. The push-button type flint ignition mechanism of claim 2, wherein the blocking member is fixed inside the mechanism.

19. The push-button type flint ignition mechanism of claim 18, wherein the blocking member is elastically deformable.

20. The push-button type flint ignition mechanism of claim 2, wherein contact surfaces between the moving member and the driving body comprise a sloped or curved surface.

21. The push-button type flint ignition mechanism of claim 2, wherein the driving wheel is spur gear.

22. The push-button type flint ignition mechanism of claim 2, wherein the grinding wheel and the driving wheel are integrally formed into a single unit similar to a conventional grinding wheel in overall structure.

23. The push-button type flint ignition mechanism of claim 2, wherein the grinding wheel, the driving wheel, and the wheel axle are integrally formed.

24. The push-button type flint ignition mechanism of claim 2, being part of a cigarette lighter or utility lighter and further comprising a fuel storage and release mechanism configured to release fuel during the actuation motion such that the spark generated is used to light a flame.

25. The push-button type flint ignition mechanism of claim 1, wherein at least one of the energy storage member and the reset member comprises a spring.

* * * * *